US011174997B2

(12) United States Patent
Wu et al.

(10) Patent No.: US 11,174,997 B2
(45) Date of Patent: Nov. 16, 2021

(54) INTELLIGENT LAMP INCLUDING LIGHT SOURCE MODULE AND COMMUNICATIONS MODULE

(71) Applicant: XIAMEN ECO LIGHTING CO. LTD., Xiamen (CN)

(72) Inventors: Chihhsien Wu, Xiamen (CN); Renhua Zhou, Xiamen (CN); Maohua Lin, Xiamen (CN); Ronglin Xu, Xiamen (CN); Pofeng Peng, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 71 days.

(21) Appl. No.: 16/811,993

(22) Filed: Mar. 6, 2020

(65) Prior Publication Data

US 2020/0284400 A1 Sep. 10, 2020

(30) Foreign Application Priority Data

Mar. 7, 2019 (CN) ..... 201920290327.5

(51) Int. Cl.

| | |
|---|---|
| ***F21K 9/237*** | (2016.01) |
| ***F21V 29/71*** | (2015.01) |
| ***F21K 9/235*** | (2016.01) |
| ***H05B 47/19*** | (2020.01) |
| ***H05B 45/357*** | (2020.01) |
| ***F21Y 115/10*** | (2016.01) |

(52) U.S. Cl.

CPC ..... *F21K 9/237* (2016.08); *F21K 9/235* (2016.08); *F21V 29/71* (2015.01); *H05B 45/357* (2020.01); *H05B 47/19* (2020.01); *F21Y 2115/10* (2016.08)

(58) Field of Classification Search

CPC . F21K 9/232–238; F21V 23/003–0492; F21V 29/70–717; F21Y 2115/10; H01Q 1/44–48; H05B 45/357; H05B 47/19

See application file for complete search history.

(56) References Cited

U.S. PATENT DOCUMENTS 9,039,243 B2 * 5/2015 Ju ..... F21V 7/00 362/294

* cited by examiner

*Primary Examiner* — Jason M Han

(74) *Attorney, Agent, or Firm* — Chun-Ming Shih; Lanway IPR Services

(57) ABSTRACT

An intelligent lamp includes a heat dissipation element, a cover element, a lamp holder, a light source module and a communications module. The heat dissipation element has a hollow structure inside. The cover element is disposed to cover a side of the heat dissipation element. The lamp holder assembly is disposed at another side of the heat dissipation element. The light source module is disposed in the heat dissipation element, is electrically connected to the lamp holder assembly, and includes a light source board disposed on in the heat dissipation element. The communications module is disposed through the light source module, is electrically connected to the lamp holder assembly, and includes an antenna and a radio frequency module disposed at two opposite sides of the light source board. A plurality of ground components are disposed on the radio frequency module and the ground components contact the light source board.

20 Claims, 6 Drawing Sheets

INTELLIGENT LAMP INCLUDING LIGHT SOURCE MODULE AND COMMUNICATIONS MODULE

BACKGROUND OF THE INVENTION

1. Field of the Invention

The disclosure is related to an intelligence lamp, and more particularly, an intelligence lamp including a light source module and a communications module with improved antenna performance.

2. Description of the Prior Art

With the rapid development of light-emitting diode (LED) technology, LED lighting has gradually become a highly preferred choice for new environmentally friendly lighting. LED is much superior to traditional lighting products in terms of light emitting principle, energy saving and environmental protection.

In an existing intelligent lamp, a radio frequency (RF) module and an antenna may be integrated on a small-sized card, so that it can be used as an independently operated module. However, if the small card is surrounded by metal, the radiation of the antenna will be reduced, and the stability of transceiving signals by the lamp will be relatively poor. In the past, for bulb-type lamp products, the antennas can be optimized by modifying the antenna routing or changing the matching parameters. However, the optimization effect was limited. Therefore, an antenna height can be increased to improve communications performance, but this will affect the luminous efficiency to a certain level.

SUMMARY OF THE INVENTION

An embodiment provides an intelligent lamp including a heat dissipation element having a hollow structure inside; a cover element disposed to cover a side of the heat dissipation element; a lamp holder assembly disposed at another side of the heat dissipation element; a light source module disposed in the heat dissipation element, electrically connected to the lamp holder assembly, and comprising a light source board disposed in the heat dissipation element; and a communications module disposed through the light source module, electrically connected to the lamp holder assembly, the communications module comprising an antenna and a radio frequency module disposed at two opposite sides of the light source board, where a plurality of ground components are disposed on the radio frequency module and the ground components contact the light source board.

Optionally, one of the ground components includes a spring leaf coupled between the radio frequency module and the light source board.

Optionally, the spring leaf has a straight shape.

Optionally, the spring leaf has an arc shape.

Optionally, the spring leaf has a bent shape.

Optionally, one of the ground components includes a connector coupled between the radio frequency module and the light source board.

Optionally, a copper exposed area is disposed on the light source board, and the ground components contact the copper exposed area.

Optionally, the lamp holder assembly further includes a lamp holder coupled to the heat dissipation element; and a driver element coupled between the lamp holder and the light source board.

Optionally, the light source module further includes at least a light-emitting diode light source disposed on the light source board; where the driver is electrically connected to the light-emitting diode light source and configured to drive the light-emitting diode light source.

Optionally, the heat dissipation element further includes a heat dissipation layer where the light source board is disposed to cover a portion of the heat dissipation layer; and an insulation layer where the lamp holder is screwed with a portion of the insulation layer; where the heat dissipation layer and the insulation layer are disposed from an inner position to an outer position in order.

Compared with a previous lamp, in an intelligent lamp provided by an embodiment of the present disclosure, because the light source board and the radio frequency (RF) module may be coupled via the ground components, the ground of the antenna, the ground of the RF module, the light source board and the heat dissipation element may be integrated. Compared with a design of prior art, there are some improvements as follows.

(1) By integrating the ground of the light source board and the RF module, the metal structure of the heat dissipation element of the lamp may be integrated to make the heat dissipation element a part of the antenna. The ability of transceiving signals of the antenna may be improved. The communication performance of the antenna may be improved without increasing the height of the antenna.

(2) By coupling the ground of the RF module, the light source board and the heat dissipation element, the electrostatic path will be improved. The static electricity may flow through the RF module to the ground component, and from the ground component to the light source board. The static electricity on the light source board may be discharged to the heat dissipation element.

(3) The communication performance of the product may be improved without affecting the appearance. The aesthetics and other functions of the whole lamp will not be affected.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
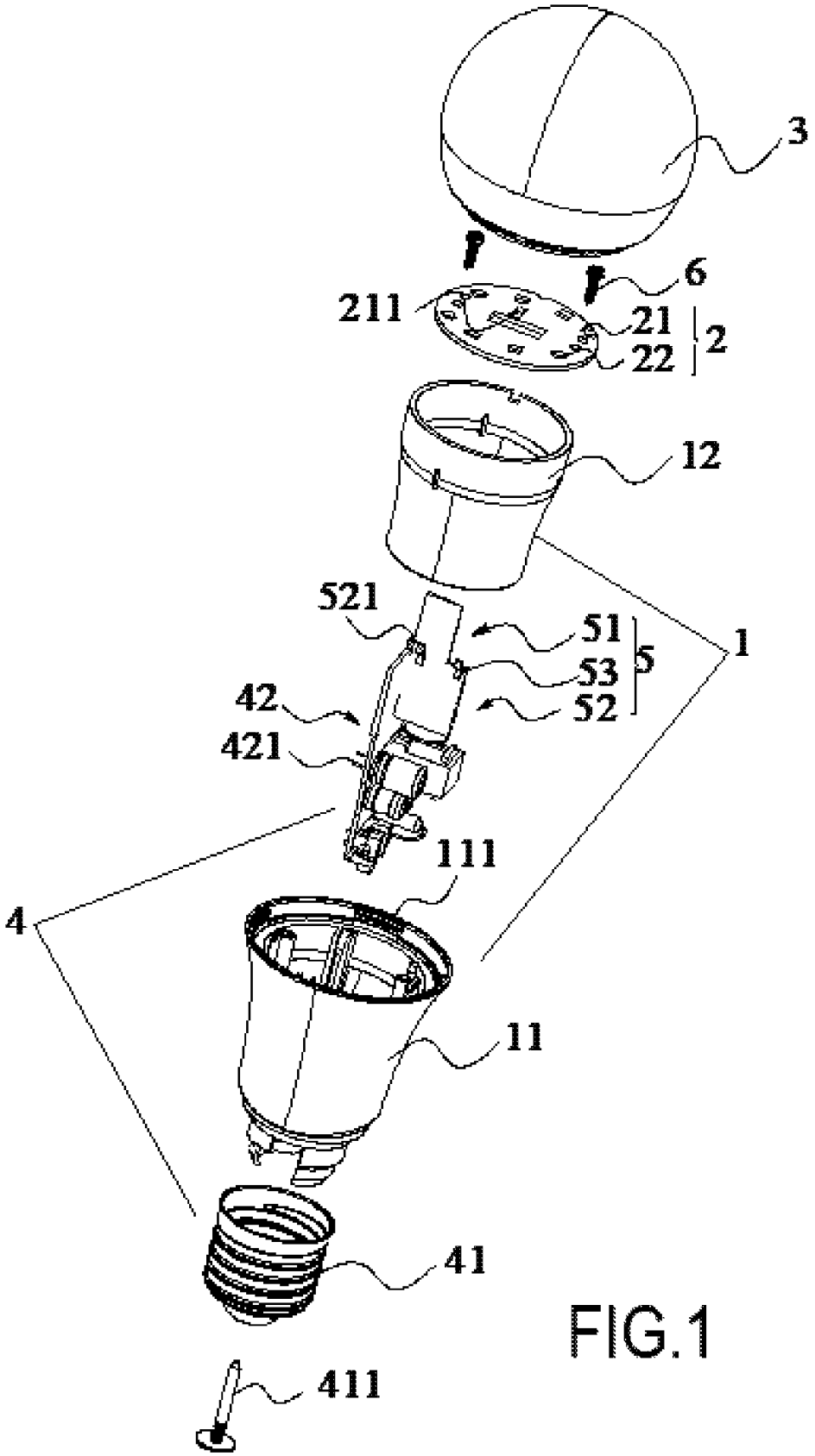
FIG. 1 illustrates an exploded diagram of an intelligence lamp according to an embodiment of the disclosure.

In order to make the technical problems solved by the present disclosure and technical solutions and beneficial effects related to the present disclosure to be more clearly understood, the present disclosure will be further described in detail with reference to drawings and embodiments as follows. It should be understood that the embodiments described herein are only used to explain the present disclosure and are not intended to limit the present disclosure.

It should be noted that when an element is referred to as being "fixed to" or "disposed on" another element, it may be directly located on another element or indirectly located on another element. When an element is referred to as being "connected to" another element, it can be directly connected or indirectly connected to the other element.

It should be understood that directions or locations related to the terms such as "length", "width", "higher position", "lower position", "front", "back", "left", "right", "vertical", "horizontal", "top", "bottom", "inside" and "outer" may be related to the directions or the locations shown in the drawings and be merely used to conveniently described the disclosure rather than indicating that a device or an element must be built or operated in specific directions. Hence, directions and orientations mentioned herein are not used to limit the present disclosure. In addition, the terms "first" and "second" herein are merely used for description instead of limiting importance or number of elements. Herein, the term "a plurality" may mean two or more unless it is specifically defined otherwise.

The disclosure is described below in more detail with some embodiments.

Figure 2:
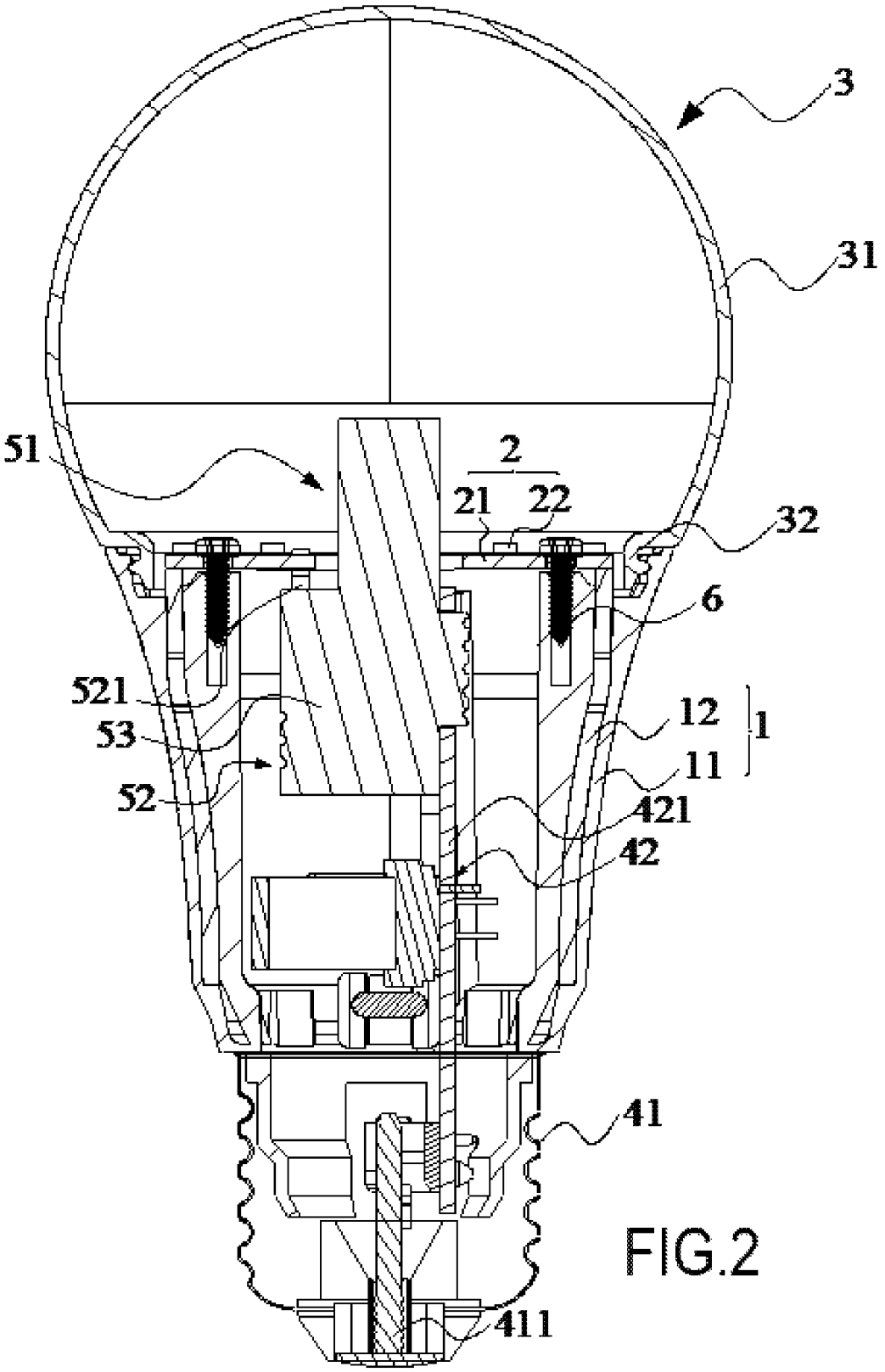
FIG. 2 illustrates a cross-sectional diagram of the intelligence lamp according to an embodiment of the disclosure.
Figure 3:
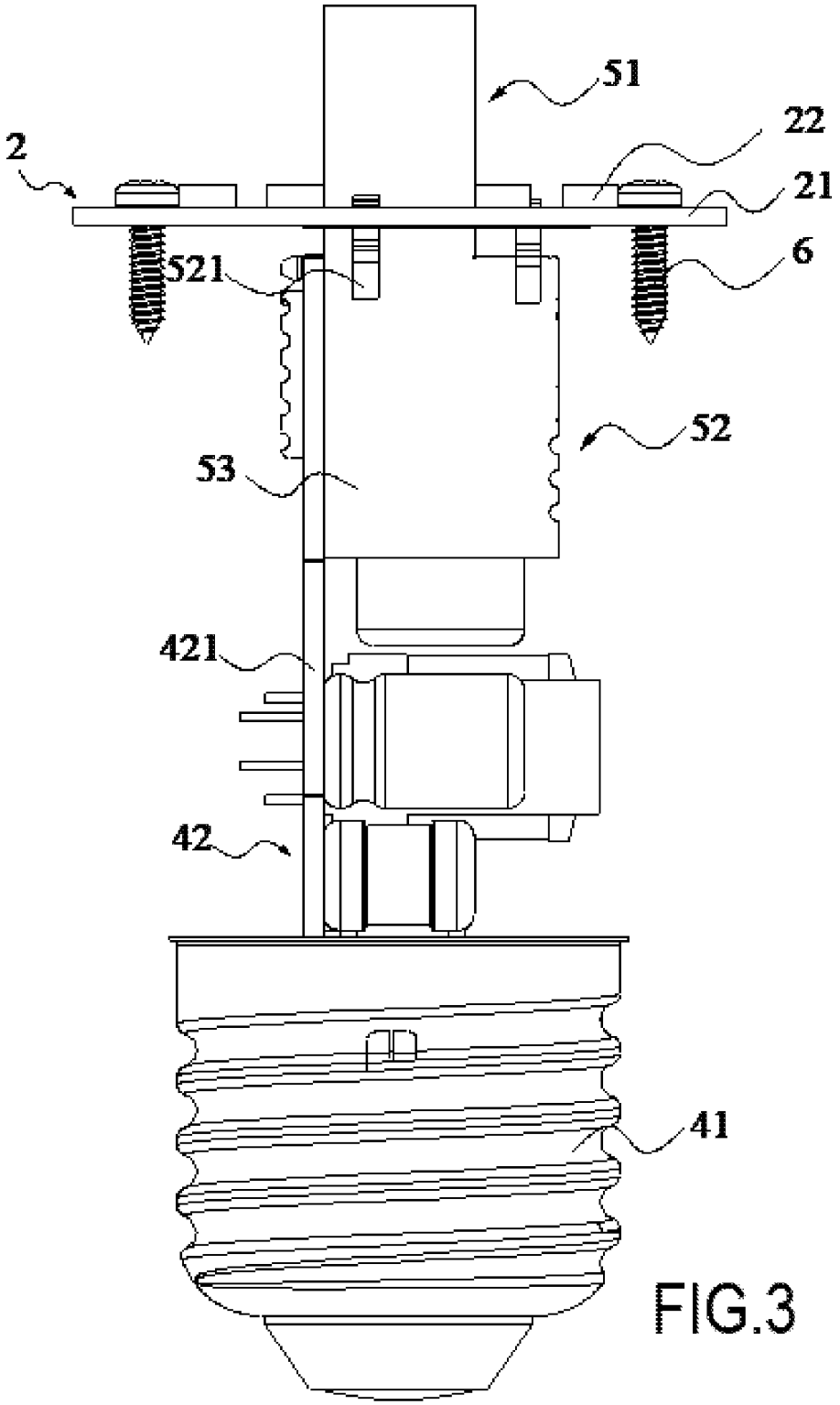
FIG. 3 illustrates a three dimensional structure of the intelligence lamp of FIG. 1 where the cover element and the heat dissipation element is not shown.

As shown in FIG. 1 to FIG. 3, an intelligent lamp provided by an embodiment includes a heat dissipation element 1 having a hollow structure inside, a cover element 3 disposed to cover a side of the heat dissipation element 1, a lamp holder assembly 4 disposed at another side of the heat dissipation element 1, a light source module 2 disposed in the heat dissipation element 1 and electrically connected to the lamp holder assembly 2, and a communications module 5 disposed through the light source module 2 and electrically connected to the lamp holder assembly 4. The light source module 2 may include a light source board 21 disposed in the heat dissipation element 1. The communications module 5 may include an antenna 51 and a radio frequency (RF) module 52 disposed at two opposite sides of the light source board 21. The light source board 21 may separate the antenna 51 and the RF module 52 into two areas where the RF module 52 may be in a cavity area formed by the light source board 21 and the heat dissipation element 1, and the antenna 51 may extend beyond the light source board 21. A plurality of ground components 521 are disposed on the RF module 52 and the ground components 521 may conductively contact the light source board 21. In other words, the RF module 52 may be coupled to the light source board 21 via the ground components 521 so that a ground of the antenna 51 (i.e. a ground of the RF module 52) may be coupled to the light source board 21. According to an embodiment, this design concept is applicable to products related to lambs such as bulb devices, and also feasible for related products including an RF module (e.g., the RF module 52) and an antenna (e.g., the antenna 51).

Because the light source board 21 and the RF module 52 may be coupled via the ground components 521, the ground of the antenna 51, the ground of the RF module 52, the light source board 21 and the heat dissipation element 1 may be integrated. Compared with a design of prior art, there are some improvements as follows.

(1) By integrating the ground of the light source board 21 and the RF module 52, the metal structure of the heat dissipation element 1 of the lamp may be integrated to make the heat dissipation element 1 a part of the antenna. The ability of transceiving signals of the antenna 51 may be improved. The communication performance of the antenna 51 may be effectively improved without increasing the height of the antenna 51.

(2) By coupling the ground of the RF module 52, the light source board 21 and the heat dissipation element 1, the electrostatic path will be improved. The static electricity may flow through the RF module 52 to the ground component 521, and from the ground component 521 to the light source board 21. The static electricity on the light source board 21 may be released to the heat dissipation element 1.

(3) The communication performance of the product may be improved without affecting the appearance. The aesthetics and other functions of the whole lamp will not be affected.

The heat dissipation element 1 and the cover element 3 may cover the light source module 2 and the communications module 5 inside to protect them. The heat dissipation element 1 may include an insulation layer 11 and a heat dissipation layer 12 disposed from an outer position to an inner position in order, where the inner position may be closer to the light source board 21. The heat dissipation layer 12 may be made of aluminum. The aluminum heat dissipation element 1 may dissipate heat and have a relatively higher conductivity. The insulation layer 11 may be disposed outside the heat dissipation layer 12 to avoid electric shock when touched by a human hand. The heat dissipation layer 12 may form a cylinder with two ends open. The insulation layer may form a cup body with two ends open. The light source board 21 may cover on the heat dissipation layer 12 and be fixed using connection elements such as the screws 6. The heat dissipation layer 12 may support and fix the light source board 21.

The cover element 3 may have a shape of a bulb. For the light source module 2 to emit light more easily, the cover element 3 may be formed using a transparent material such as a polycarbonate (PC) or a polyethylene terephthalate (PET) plastic material, so that a high transmittance can be assured, and the light can be emitted evenly. According to an embodiment, the cover element 3 may be engaged with the insulation layer 11 at the outer position. The cover element 3 may include a bulb part 31 and a buckle 32 where the buckle 32 may be bent toward the insulation layer 11 from a circumferential portion at an end of the bulb part 31. A circumferential portion of the insulation layer 11 may have a clamping groove 111 corresponding to the buckle 32. The buckle 32 and the clamping groove 111 may be used to be attached and detached with each other. The fit clearance between the cover element 3 and the insulation layer 11 may be substantially between 0 mm to 0.3 mm (millimeters), and there may be no requirement for thickness difference. According to an embodiment, a fit clearance between the cover element 3 and the insulation layer 11 may be substantially 0 mm, 0.1 mm, 0.2 mm or 0.3 mm.

According to an embodiment, the lamp holder assembly 4 may include a lamp holder 41 and a driver element 42. The driver element 42 may be coupled between the lamp holder 41 and the light source board 21. The RF module 52 may be coupled to the driver element 42 by insertion. According to an embodiment, the communications module 5 may include a printed circuit board (PCB) 53 where the antenna 51 and the RF module 52 may be disposed on the PCB 53. The RF module 52 and the antenna 51 may be coupled to one another via the feeding wires (not illustrated) of the PCB 53. The driver element 42 may include a driver board 421 and components located on the driver board 421. The PCB 53 and the driver board 421 may be coupled by being orthogonally inserted, so that the lamp holder 41 may be electrically connected with the PCB 53 via the driver board 421. The ground component 521 may be disposed on the PCB 53, and the ground component 521 may conductively contact the light source board 21.

As shown in FIG. 2, an end of the lamp holder 41 may be attached with the insulation layer at an outer position by screwing. Another end of the lamp holder 41 may be electrically connected to an external power source through a pin 411 located inside. The pin 411 may be used to provide currents for the RF module 52 and the light source module 2 respectively through the driver element 42. The fir clearance between the lamp holder 41 and the insulation layer 11 may be substantially between 0 mm to 0.2 mm without requirement for thickness difference. According to an embodiment, the fir clearance between the lamp holder 41 and the insulation layer 11 may be substantially 0 mm, 0.1 mm or 0.2 mm.

Figure 4:
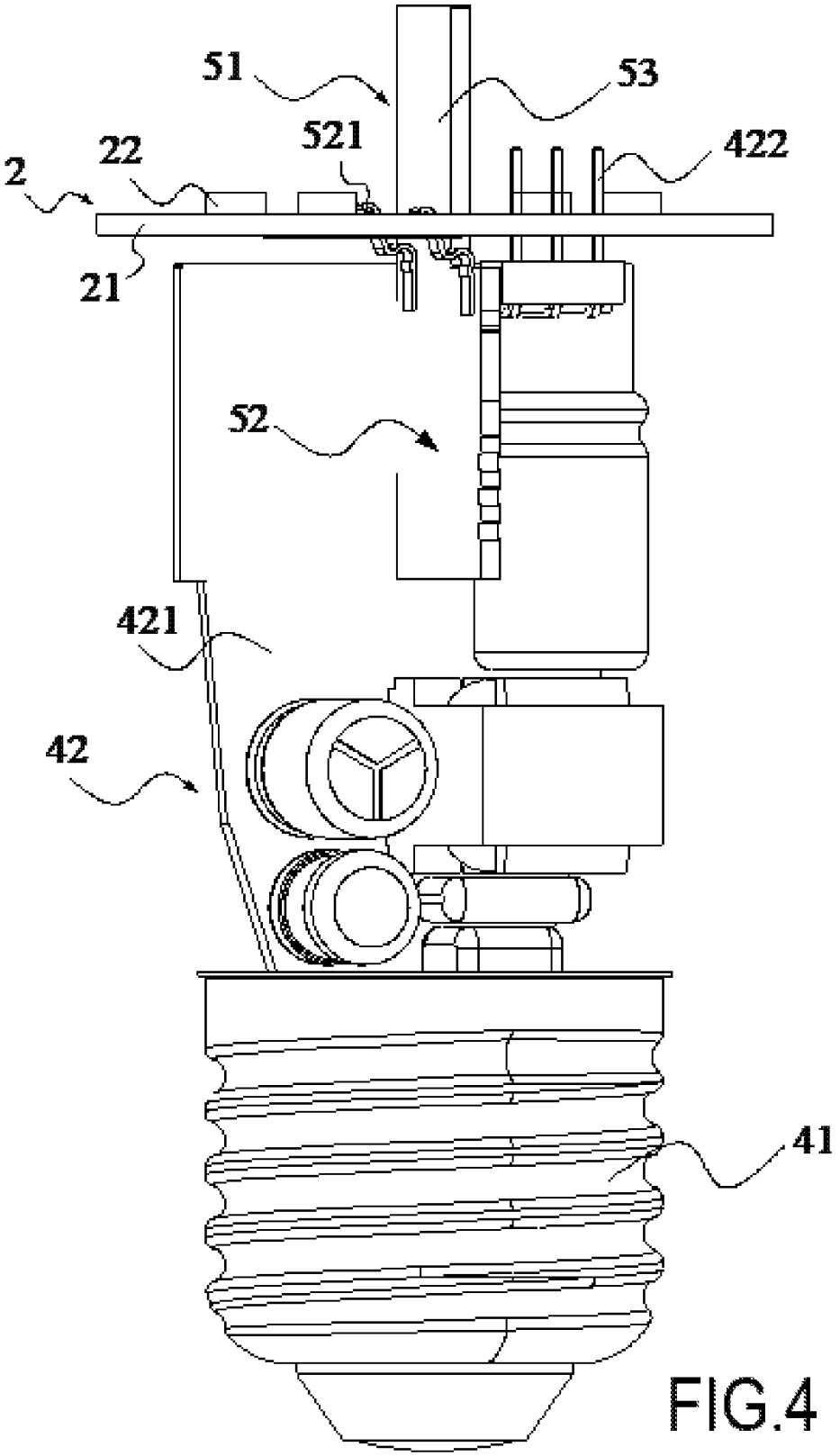
FIG. 4 illustrates a three dimensional structure of the intelligence lamp of FIG. 2 where the cover element and the heat dissipation element is not shown.

As shown in FIG. 1 and FIG. 4, an output connector 422 may be disposed on the driver element 42. An input connector (not illustrated) electrically connected to the output connector 422 may be disposed on the light source board 21. The light source board 21 may have a through hole 211, and the output connector 422 may be electrically connected to the output connector via the through hole 211. According to an embodiment, the output connector 422 may be a male connector, and the input connector may be a female connector. According to another embodiment, the output connector 422 may be a female connector, and the input connector may be a female connector. The types of the output connector 422 and the input connector may be not limited as long as the two connectors can be connected.

Please also refer to FIG. 1. The light source module 2 may further include at least one light-emitting diode (LED) light source 22 disposed on the light source board 21. The driver element 42 may be electrically connected to the LED light source 22 and be used to drive the LED light source 11 to emit light.

According to an embodiment, one of the ground components 521 may include a spring leaf coupled between the RF module 52 and the light source board 21. A portion of the spring leaf may be coupled to the PCB 53, and another portion of the spring leaf may be coupled to the light source board 21.

According to an embodiment, the spring leaf may have a straight shape. The spring leaf with a straight shape may be coupled to the PCB 53 and the light source board 21 respectively through an adhesive (e.g., an electrically conductive adhesive) or a connection element as long as the spring leaf can be fixed and kept conductive so as to have a conductive path between the PCB 53 and the light source board 21.

According to another embodiment, the spring leaf may have an arc shape, and be connected in a way that a straight-shaped spring leaf is connected as described above. For example, when a curvature of an arc-shaped spring leaf is larger, two installation holes may be respectively opened for two ends of the arc-shaped spring leaf for the spring leaf to be connected between the PCB 53 and the light source board 21 through a connection element.

Figure 5:
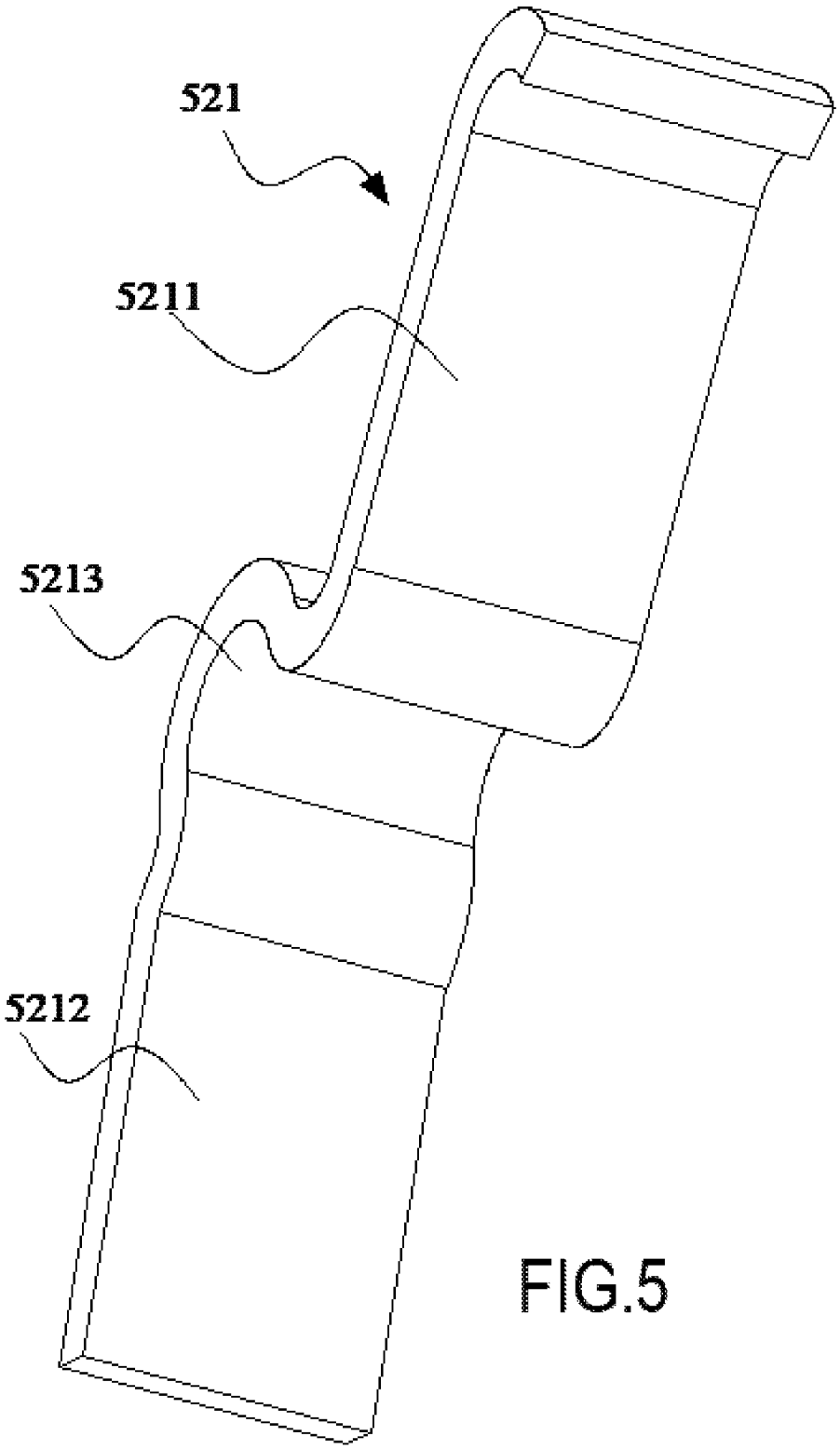
FIG. 5 illustrates a three dimensional structure of the ground component according to an embodiment.

According to an embodiment, as shown in FIG. 5, the spring leaf may have a bent shape. The spring leaf may have a first bent portion 5211, a connecting portion 5213 and a second bent portion 5212. The first bent portion 5211 may be coupled to the light source board 21. The second bent portion 5212 may be coupled to the PCB 53. The first bent portion 5211 may be extended from an end of the connecting portion 5213 toward a side of the light source board 21. The second bent portion 5212 may be extended from an end of the connecting portion 5213 toward a side of the PCB 53. The bent portions 5211 and 5212 may be optionally bent. According to an embodiment, the connecting portion 5213 may have a bent shape or an arc shape. The first bent portion 5211, the second bend portion 5212 and the connecting portion 5213 may be of an integrally formed structure, where the integrally formed structure is preferably to be made of a same material.

According to an embodiment, the abovementioned spring leaf may be a ground connector coupled between the light source board 21 and the RF module 52. Here, a connector may be a terminal which is a component used to realize electrical connection and be of the industrial category of the connectors. The said connectors may include a male connector disposed on the light source board 21 and a female connector disposed on the PCB 53, where the male connector may be inserted into the female connector to conductively connect the light source board 21 and the PCB 53. According to another embodiment, a male connector may be disposed on the PCB 53, and a female connector may be disposed on the light source board 21.

Figure 6:
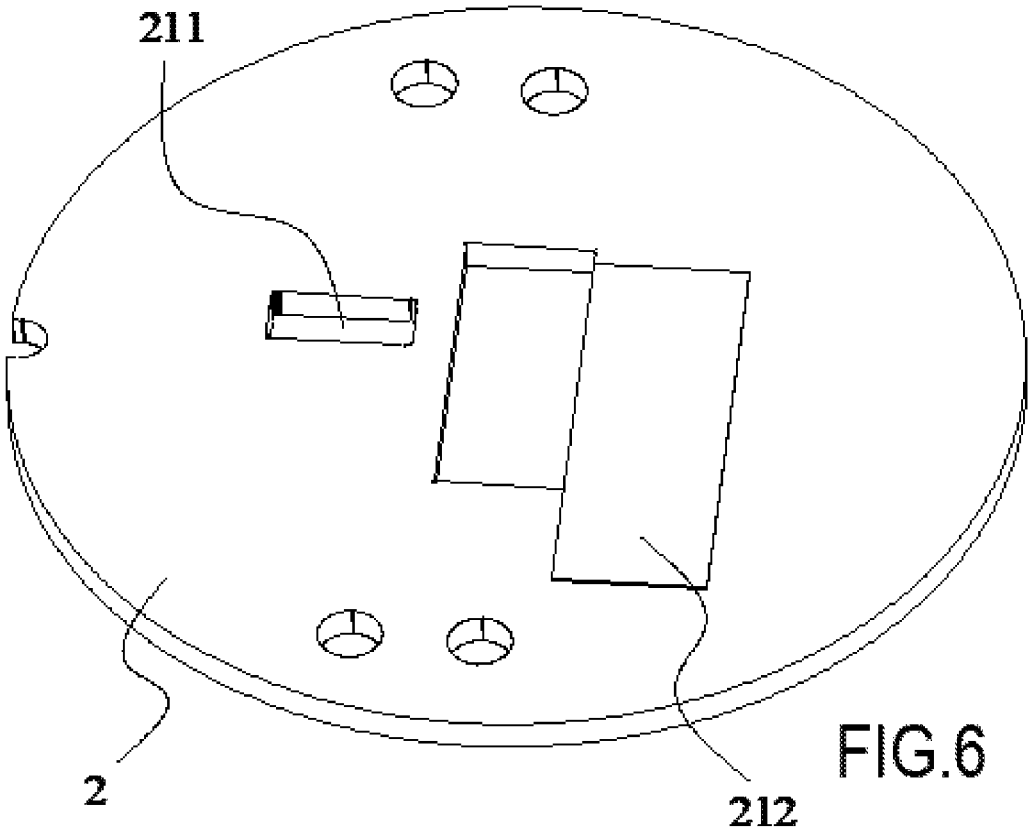
FIG. 6 illustrates a three dimensional structure of the light source board according to an embodiment.

In the light source board 21, there may be a non-conductive oxide layer. According to an embodiment, the ground component 521 may be used to conductively connect the light source board 21 and the RF module 52 by contacting a portion where the oxide layer is removed. Referring to FIG. 6, a copper exposed area 212 may be disposed on the light source board 21, and the said ground components 521 may conductively contact the copper exposed area 212. According to an embodiment, a portion of the light source board 21 being close to the ground component 521 may be processed by laser engraving or oxide removing to make the portion conductive, so the RF module 52 and the light source board 21 may be conductively connected. The whole lamp may be operated as a portion of the antenna 51, and the antenna 51 may radiate more effectively. Compared with a previous antenna design, a previous antenna has to avoid a metal surface to avoid antenna affects, and transmission efficiency is reduced. Regarding the intelligent lamp provided by an embodiment of the disclosure, metal parts close to the RF module 52 and the whole lamp may be integrated, the lamp may be used as a part of the antenna 51, so it is not necessary to avoid the metal parts, and the metal parts can be used for radiation.

According to description above, power may be provided to the LED light source 22 via the path described below. The alternating current (AC) power from an external power source may be sent through the pin 411 of the lamp holder 41 to the driver element 42. Then, the power may be sent through the output connector 422 and the input connected coupled with the output connector 422 to the light source board 21, and the current may be sent to the LED light source.

Power may be provided to the antenna 51 via the path described below. The alternating current (AC) power from an external power source may be sent through the pin 411 of the lamp holder 41 to the driver element 42. Then, the power may be sent to the PCB 53. The power may be sent to the antenna 51 through the feeding wires.

The communications module may control the light source module via the path described below. The antenna 51 may receive a control signal and send the control signal to the RF module 52. The RF module 52 may control the driver element 42 according to the control signal to drive the LED light source 22 to emit light.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An intelligent lamp comprising:

a heat dissipation element having a hollow structure inside;

a cover element disposed to cover a side of the heat dissipation element;

a lamp holder assembly disposed at another side of the heat dissipation element;

a light source module disposed in the heat dissipation element, electrically connected to the lamp holder assembly, and comprising a light source board disposed in the heat dissipation element; and a communications module disposed through the light source module, electrically connected to the lamp holder assembly, and the communications module comprising an antenna and a radio frequency module disposed at two opposite sides of the light source board, wherein a plurality of ground components are disposed on the radio frequency module and the ground components contact the light source board.

2. The intelligent lamp of claim 1, wherein a copper exposed area is disposed on the light source board, and the ground components contact the copper exposed area.

3. The intelligent lamp of claim 1, wherein the lamp holder assembly further comprises:

a lamp holder coupled to the heat dissipation element; and a driver element coupled between the lamp holder and the light source board.

4. The intelligent lamp of claim 1, wherein one of the ground components comprises a spring leaf coupled between the radio frequency module and the light source board.

5. The intelligent lamp of claim 4, wherein a copper exposed area is disposed on the light source board, and the ground components contact the copper exposed area.

6. The intelligent lamp of claim 4, wherein the lamp holder assembly further comprises:

a lamp holder coupled to the heat dissipation element; and a driver element coupled between the lamp holder and the light source board.

7. The intelligent lamp of claim 4, wherein the spring leaf has a straight shape.

8. The intelligent lamp of claim 7, wherein a copper exposed area is disposed on the light source board, and the ground components contact the copper exposed area.

9. The intelligent lamp of claim 7, wherein the lamp holder assembly further comprises:

a lamp holder coupled to the heat dissipation element; and a driver element coupled between the lamp holder and the light source board.

10. The intelligent lamp of claim 4, wherein the spring leaf has an arc shape.

11. The intelligent lamp of claim 10, wherein a copper exposed area is disposed on the light source board, and the ground components contact the copper exposed area.

12. The intelligent lamp of claim 10, wherein the lamp holder assembly further comprises:

a lamp holder coupled to the heat dissipation element; and a driver element coupled between the lamp holder and the light source board.

13. The intelligent lamp of claim 4, wherein the spring leaf has a bent shape.

14. The intelligent lamp of claim 13, wherein a copper exposed area is disposed on the light source board, and the ground components contact the copper exposed area.

15. The intelligent lamp of claim 13, wherein the lamp holder assembly further comprises:

a lamp holder coupled to the heat dissipation element; and a driver element coupled between the lamp holder and the light source board.

16. The intelligent lamp of claim 1, wherein one of the ground components comprises a connector coupled between the radio frequency module and the light source board.

17. The intelligent lamp of claim 16, wherein a copper exposed area is disposed on the light source board, and the ground components contact the copper exposed area.

18. The intelligent lamp of claim 16, wherein the lamp holder assembly further comprises:

a lamp holder coupled to the heat dissipation element; and a driver element coupled between the lamp holder and the light source board.

19. The intelligent lamp of claim 18, wherein the light source module further comprises:

at least a light-emitting diode light source disposed on the light source board;

wherein the driver is electrically connected to the light-emitting diode light source and configured to drive the light-emitting diode light source.

20. The intelligent lamp of claim 18, wherein the heat dissipation element further comprises:

a heat dissipation layer wherein the light source board is disposed to cover a portion of the heat dissipation layer; and an insulation layer wherein the lamp holder is screwed with a portion of the insulation layer;

wherein the heat dissipation layer and the insulation layer are disposed from an inner position to an outer position in order.

* * * * *